United States Patent [19]

Justus

[11] Patent Number: 4,717,604

[45] Date of Patent: Jan. 5, 1988

[54] DIE BAR CARRIER AND METHOD

[75] Inventor: Paul E. Justus, Fort Wayne, Ind.

[73] Assignee: Essex Group, Inc., Fort Wayne, Ind.

[21] Appl. No.: 867,717

[22] Filed: May 27, 1986

[51] Int. Cl.[4] ..... B05C 3/12; B05C 1/26

[52] U.S. Cl. ..... 427/434.7; 118/405; 118/DIG. 18

[58] Field of Search ..... 118/404, 405, 125, DIG. 18; 427/434.7

[56] References Cited

U.S. PATENT DOCUMENTS

| | | | |
|---|---|---|---|
| 2,915,580 | 12/1959 | Gill et al. | 174/43 |
| 2,928,636 | 3/1960 | Flower | 248/61 |
| 3,106,386 | 10/1963 | Harris | 263/3 |
| 3,142,588 | 7/1964 | Phillips | 118/407 |
| 3,161,724 | 12/1964 | Greene, Jr. et al. | 174/146 |
| 3,183,604 | 5/1965 | Stauffer | 34/18 |
| 3,183,605 | 5/1965 | Argue et al. | 34/68 |
| 3,265,033 | 8/1966 | Touze et al. | 118/61 |
| 3,351,329 | 11/1967 | Thomas | 263/3 |
| 3,596,634 | 8/1971 | Fuchs | 118/65 |
| 3,810,736 | 5/1974 | Dumas | 432/59 |
| 4,303,387 | 12/1981 | Burke et al. | 432/72 |
| 4,365,790 | 12/1982 | Horvath et al. | 266/103 |
| 4,448,578 | 5/1984 | Brunet et al. | 432/72 |
| 4,475,294 | 10/1984 | Henricks | 34/79 |
| 4,521,931 | 6/1985 | Katsuki et al. | 8/149.2 |
| 4,539,931 | 9/1985 | Kikuta et al. | 118/DIG. 18 |

*Primary Examiner*—John P. McIntosh

*Attorney, Agent, or Firm*—Lloyd D. Doigan

[57] ABSTRACT

A die bar carrier (40) has a beam (42) to support the die bar (10) having wire (20) threaded therethrough, an attachment spring (60) to couple the beam (42) to a pulling mechanism (70), and a wire retainer (50) that is spaced from the beam (42) to hold the wire (20) between the beam (42) and the retainer (50).

12 Claims, 4 Drawing Figures

DIE BAR CARRIER AND METHOD

CROSS REFERENCE TO RELATED APPLICATION

This application relates to commonly assigned, copending U.S. patent application Ser. No. 941,903, filed Dec. 12, 1986, for DIE BAR WITH INTEGRAL LOCKING MEANS by Mohamman F. Zaman; and commonly assighed, copending U.S. patent application Ser. No. 947,167, filed Dec. 29, 1986, for DIE BAR CARRIER by Mohammand F. Zaman.

TECHNICAL FIELD

This invention relates in general to wire coating and in particular to a carrier for pulling a die bar having wires threaded therethrough, through an oven.

BACKGROUND ART

Die bars are employed in manufacturing coated wire, such as insulated magnet wire. Die bars are generally rectangularly shaped, each having two sets of drilled passages: A first set drilled through the bar to receive wires threaded therethrough, and a second set to carry a liquid insulating material (such as an enamel, varnish or like coating material) from an application station terminal to each of a corresponding one of the first set of passages to coat the wires therein. If a single coat of insulating material is to be applied, the wire is pulled through the die bar where the wire is coated and then through an oven for curing. If the wire is to receive a number of coats of insulating material after the curing of the initial coat, the wire is pulled and guided around the oven to another of a corresponding number of application station terminals having a die bar appended thereto for further coating. Curing and coating then continue until the wire receives the desired number of coats.

During the start-up of a multicoat coating process, the wire is threaded through a series of die bars, each successive die bar having increasingly sized coating passages. The first die bar has the smallest passages for initially coating a bare wire threaded therethrough. Successive bars have increasingly larger passages for coating previously cured coated wire. The wire is threaded through all of the die bars prior to being threaded through the oven.

After threading the wire through all the die bars, the first die bar having the smallest passages is held at a first application station terminal. The wire and the other die bars are drawn through the oven by a rope tied to the die bars. The wire and other die bars are then directed around the oven to a second application station terminal where the die bar having the next larger passages is held to apply a second coating to the wire. The wire and other die bars are pulled through and around the oven, placing the die bars in subsequent application station terminals, until the die bar having the largest sized passages is held at a final application station terminal. The wire assumes a helical shape passing through a die bar, through and around the oven, through a second juxtaposed die bar, through and around the oven etc., until the wire is finally threaded through the oven. Once the wire is threaded, the application station terminals are activated to apply the plurality of coatings to the wire as the wire is pulled through and around the oven.

The prior art does not reveal an effective device for drawing the die bars through the oven. Current practice calls for kinking the wire above a first die bar to be threaded through the oven and behind the other die bars, and then tying a rope about the first die bar to pull the die bars and wire threaded therethrough through the oven. As the kinks will not pass through the die bar passages, the engagement of the wire kinks with the die bar causes the die bar to be supported and carried by the wire as the wire is drawn through the oven. However, the kinking must be removed (the wire straightened) prior to coating, to allow the wire to pass through the die bars passages. Such kinking and straightening weakens the wire, making it prone to breakage. Moreover, more delicate wire cannot suoport the weight of the die bar, engendering further breakage. The kinking also forces the wire to carry the die bars at odd angles risking snagging the wire and die bar in the oven or entry and exit openings thereof. Further, the wire may be laterally unrestrained as it passes through the oven, providing little or no impedance to harmonic or lateral motion that may develop in the wire, greatly increasing the probability that the die bar or wire may snag within the oven. If the wire is cured in vertical ovens, the wire must be kinked below the die bars to support the die bars while traveling up through the oven, and above the die bars for supporting the die bars while traveling back down the oven with the wire. Failure to kink the wire above the die bar, may permit the die bar to slide down the wire in an uncontrolled manner, thereby increasing the probability of breakage.

Accordingly, what is needed in the art is a carrier for supporting and pulling die bars through a curing oven without interference with, or breakage of the wire and without snagging the die bar in the oven or the entry or exit openings thereof.

DISCLOSURE OF THE INVENTION

It is, therefore, an object of the present invention to support and carry a die bar through and around an oven.

It is a further object of the present invention to provide a carrier to support a die bar to eliminate the necessity of kinking wire passing through the die bar.

It is a further object of the present invention to eliminate the necessity of supporting the weight of a die bar by the wire passing therethrough.

It is a further object of the present invention to dampen any harmonic or lateral motion within the wire that may cause the wire or die bar to be snagged in an oven or the entry or exit openings thereof.

These and other objects of the present invention are attained by providing a carrier to support the die bar, the carrier having a beam on which the die bar rests and an attachment means joined to the beam for attaching the beam to wire drive cables passing through the oven. As the carrier supports the die bar, the need to kink the wire is eliminated. Further, as the cables support the carrier, the weight of the die bar is not carried by the wire. In the preferred embodiment, a retainer is attached to the beam to contain the wires between the retainer and the beam, thereby dampening any harmonic or lateral motion that may cause snagging of the wire or the die bar in the oven.

Other objects and advantages of this invention will become apparent in light of the teachings in the following description of the invention and accompanying drawings.

BEST MODE FOR CARRYING OUT THE INVENTION

Figure 1:
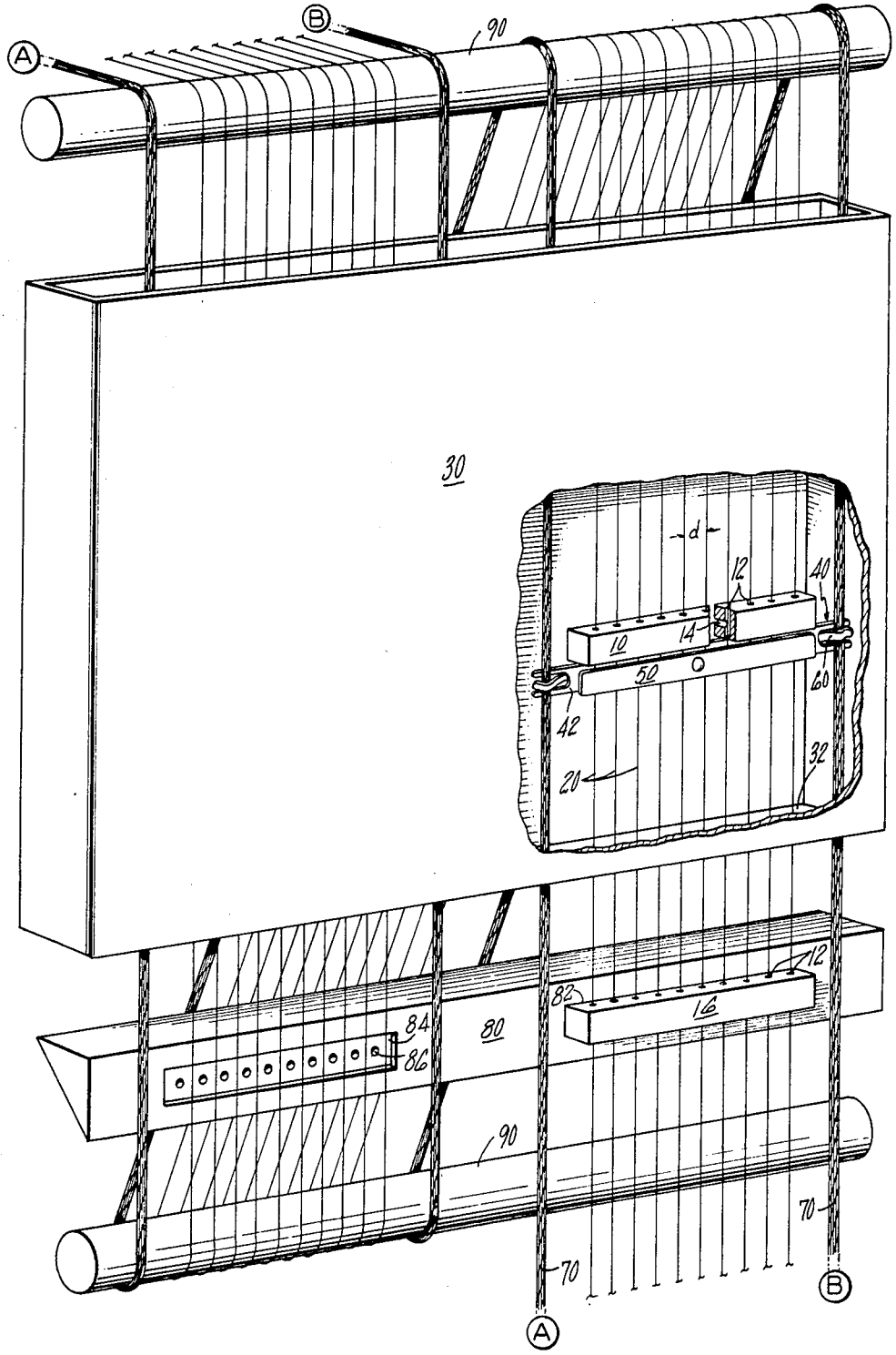
FIG. 1 is a perspective view, partly in section and partly broken away, of the invention within the environment in which it is used.

Referring to FIG. 1, there is shown a carrier 40 of this invention supporting a die bar 10 while being attached to cables (i.e., driving means) 70 that pass endlessly through oven 30 and comprise a portion of a mechanism 90 for pulling the wire through the oven.

Die bars 10, 16 each have passages 12 therethrough to receive wires spaced a distance d from each other and to apply to the wires in each passage a liquid coating material. Each die bar is appended to a terminal of an application station 80 (die bar 16 is shown appended to terminal 82) to receive a liquid coating material flowing through orifices 86 to aligned die bar ports 14, the ports directing the coating material to passages 12 and wires 20. Die bar 10 is shown being threaded through oven 30 to be appended to terminal 84 to apply a second coating to the wire passing through the oven. Wires 20 assume a helical shape passing through and around the oven.

Figure 2:
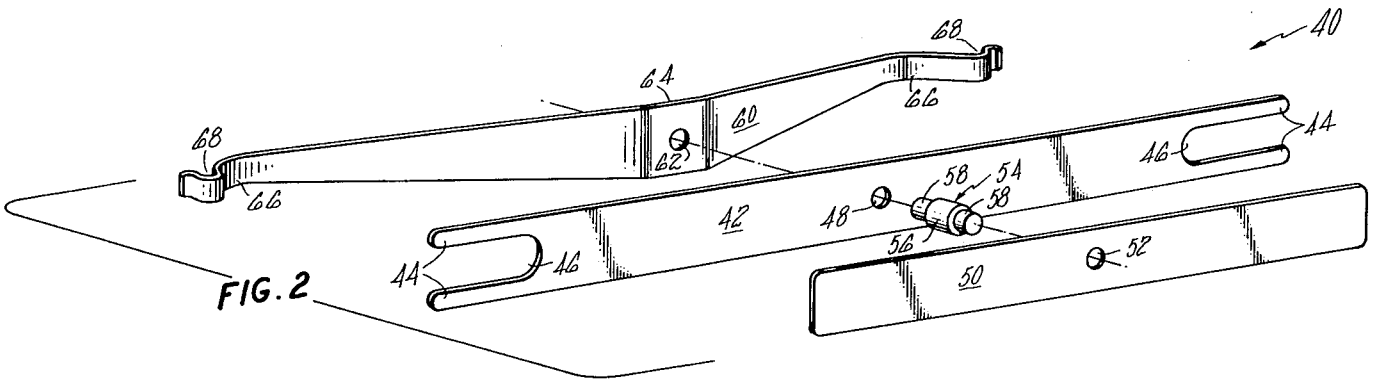
FIG. 2 is an exploded, isometric view of the carrier of this invention.
Figure 3:
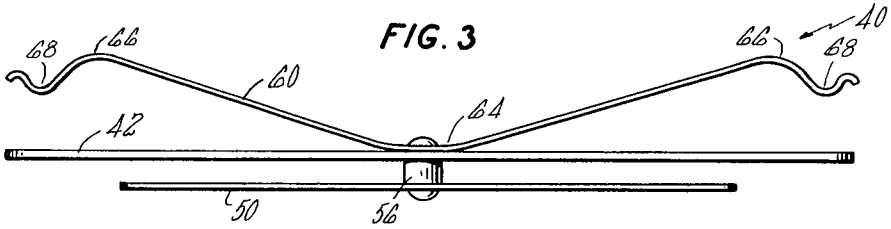
FIG. 3 is a side elevation of the carrier of this invention.
Figure 4:
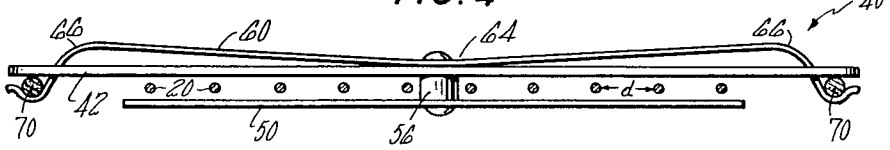
FIG. 4 is a further side view of the carrier engaged with a pulling mechanism of a wire curing oven.

Referring to FIGS. 2 through 4, carrier 40 includes a beam 42 for supporting a die bar, the beam comprising a thin, flat, rectangular bar having parallel major and minor faces. The major faces have end portions 44 notched at 46. The minor faces supoort the die bar. The beam has a hole 48 passing therethrough, proximate the midpoint of its major faces for attachment to a wire retainer 50. Preferably the beam is fabricated from stainless steel, ideally having a hardness of 17-4pH.

Similarly, the wire retainer 50 is a thin flat rectangular bar having parallel major and minor faces made from identical material to that of the beam. The retainer is shorter than the beam 42, but long enough to retain a number of wires 20 between the retainer and the beam. The major faces of the retainer are narrower in width than the distance d between the wires (see FIGS. 1 and 4) to allow the retainer to be inserted between the wires while parallel thereto as will be discussed infra. The retainer has a hole 52 extending therethrough proximate a midpoint of each major face, the hole being aligned with beam hole 48 for subsequent attachment of the retainer to the beam.

The retainer 50 and the beam 42 are connected by a coupling 54 which spaces the beam 42 and the retainer 50 so the retainer 50 can restrain the wires 20 without interfering therewith (see FIG. 4) and allows the beam and the retainer to rotate relative to each other. Even though the spacing of the beam and the retainer by the coupling keep the retainer from interfering with the wire, the spacing is narrow enough so that the beam and retainer cooperate to dampen any harmonic or other lateral motion in the wire normal to a longitudinal axis of the die bar, reducing the risk of such motion dislodging a supported die bar from the beam or snagging the wire or die bar in the oven. The coupling 54 is of a width less than d so that it may be inserted between the treated wires while normal thereto and of a length which precludes either the retainer or the support from interfering with the curing oven 30 or the oven's entry or exit openings 32. Preferably, the coupling 54 is a rivet (see FIG. 2) having a thick, barrel-shaped shank 56 for spacing the support and the retainer from each other, and a narrow coaxial cylindrical portion 58 extending from each end of the medial shank portion to form rivet heads when deformed.

A leaf spring 60 is attached to the beam on a major face thereof, on the opposite side of the beam from the retainer. As with the beam and the retainer, the leaf spring 60 has a hole 62 extending therethrough, proximate the midpoint thereof, for connection to the beam 42 by the rivet 54. The spring is attached to the beam 42 at an apogee of a major spring camber 64 (see FIG. 3). Extending from both sides of the major spring camber 64 are a reverse camber 66 and a lip 68. The lip 68 clamps cable 70 to the beam 42 through the notch 46 against the end portion 44 of the beam 42 (see FIGS. 1 and 4). The leaf spring is preferably made out of heat treated spring steel.

The cables 70 which provide mechanical connections for mechanisms that pull the wire through the oven, are formed from stainless steel and are located at either side of the oven. The cables are pulled longitudinally and endlessly through and around the oven 30 by suitable drive means such as an electric motor (not shown) connected to the mechanism (i.e., sheaves) 90 at a rate equal to the proper speed for curing the wire. Each end of the beam is clamped to a corresponding cable by the spring to hold the carrier 40 perpendicularly to the cables, thereby avoiding misalignment of the die bar with the wires and interference with the oven. A clamping force of three pounds ensures that the carrier stays attached to the cable without slipping while pulling and holding the die bar.

During start-up of the coating operation, all of the die bars having wires threaded therethrough are loaded on carriers for movement through the oven (see FIG. 1), except the die bar having the smallest passages which is appended to a first application station terminal 82 to apply the first coating to the bare wire. To effect such loading, the retainer 50 of each carrier is rotated 90° relative to beam 42 which is oriented perpendicularly to the wires 20 along its length. The retainer, now parallel to the wires, and the coupling are then inserted between the wires. The retainer is then reversely rotated 90° capturing the wire between the beam and the retainer thereby (see FIG. 4). Each carrier 40 is slid along the wire until an upper minor face of the beam engages the lower side of the die bar 10 (see FIG. 1). The beam engages the die bar off-center from the die bar holes leaving the die bar somewhat unbalanced on the beam. However, the retainer upper minor face prevents the die bar from rotating off the beam while being pulled, thereby preventing damage to the wire. Finally, the spring lip 68 is bowed through the notches 46 in the beam to clamp each carrier to the cable 70 which moves the die bars 10 through the oven 30. Because each beam and retainer cooperate to dampen lateral harmonic motion, each die bar is carried securely by an associated beam without risk of the die bar being dislodged by the wire motion, further diminishing the probability of snagging or breakage of the wire.

When the die bar having the next larger sized passages reaches the application station terminal 84 (after having passed through and around the oven), the die bar with the next larger sized passages is unloaded from its carrier for attachment to terminal 84. Unloading is effected by unclamping the spring, rotating the retainer until it is parallel to the wires, and removing the carrier. Once each corresponding die bar is appended to its related terminal, continuous coating of the wire begins as the wires pass through the die bars and the oven. If the die bars are used in a vertical oven as shown in FIG. 1, a carrier may be attached both on top and on the bottom of the die bars to stop the die bars from sliding down the wire when the wire moves from the top of the oven back down for subsequent curing. The top carrier ensures that the die bars do not put undue stress on the wire as the wire and the die bar descend.

Accordingly, the carrier of the present invention is characterized by a relatively simple construction, pulling and supporting the threaded die bars through an oven without the die bars interfering with the wire and without the die bars or wire snagging in the oven or its entry or exit openings. The die bar carriers reduce wire breakage and material stress by eliminating kinking, by reducing snagging, by damping harmonic or lateral wire motion, by supporting the weight of the die bar, and by controlling the travel of the die bars through and around the ovens.

It should be understood that this description of the invention is intended to enable those skilled in the art to practice the invention and that various changes and additions may be made thereto without departing from the spirit and scope of the invention. Particularly, one might reduce the width of the major beam faces to allow the die bar to be supported by the minor edge faces of both the beam and the retainer. One of ordinary skill in the art might also removably attach the retaining means to the beam.

Having thus described the invention, what is claimed is:

1. Apparatus for supporting and pulling a die bar, said die bar having wires threaded therethrough, said apparatus being characterized by:

a beam having an upper face for removably supporting a lower side of said die bar, pulling means for moving said beam, and attaching means fastened to said beam for attaching said beam to said pulling means.

2. The apparatus of claim 1 further characterized by:

a retaining means for dampening lateral harmonic wire motion normal to longitudinal axis of said die bar to prevent said die bar from not being supported by said beam, and a coupling joining said beam and said retaining means and spacing said beam and said retaining means so that said wires are maintained between said beam and said retaining means.

3. The apparatus of claim 2 characterized by said coupling joining said beam and said retaining means for relative rotation therebetween.

4. The apparatus of claim 3 further characterized by:

said beam having two end portions, each end portion having a notch formed therein, and said attaching means having spring means attached to a first side of said beam wherein said spring means is extendable through said notches to clamp said pulling means against a second side of said beam.

5. The apparatus of claim 3 wherein said coupling comprises a rivet.

6. The apparatus of claim 2 further characterized by:

said beam having two end portions, each end portion having a notch formed therein, and said attaching means having spring means attached to a first side of said beam wherein said spring means is extendable through said notches to clamp said pulling means against a second side of said beam.

7. The apparatus of claim 1 further characterized by:

said beam having two end portions, each end portion having a notch formed therein, and said attaching means having spring means attached to a first side of said beam wherein said spring means is extendable through said notches to clamp said pulling means against a second side of said beam.

8. A method for moving a die bar having wires threaded therethrough through a space characterized by:

abutting an upper face of a beam against a lower side of said die bar to removably support said die bar;

attaching said beam to a driving means for moving said supporting beam and die bar through a space; and activating said driving means for moving said supporting beam and die bar.

9. The method of claim 8 further characterized by:

joining a wire retaining means to said beam, and retaining said wires between said beam and said retaining means.

10. The method of claim 9 further characterized by:

attaching the beam to the driving means by providing said beam with a notch in each end portion thereof;

providing spring means attached to a first side of said beam; and extending said spring means through said notches to clamp said driving means against a second side of said beam.

11. The method of claim 8 further characterized by:

attaching the beam to the driving means by providing said beam with a notch in each end portion thereof;

providing spring means attached to a first side of said beam; and extending said spring means through said notches to clamp said driving means against a second side of said beam.

12. Apparatus for supporting and pulling a die bar, said die bar having wires threaded therethrough, said apparatus characterized by:

a beam for supporting said die bar, said beam having two end portions, each end portion having a notch formed therein, pulling means for moving said beam, and attaching means fastened to said beam for attaching said beam to said pulling means, said attaching means having a spring means attached to a first side of said beam, said spring means being extendable through said notches to clamp said pulling means against a second side of said beam.

* * * * *